US006530501B2

(12) United States Patent
Till

(10) Patent No.: US 6,530,501 B2
(45) Date of Patent: Mar. 11, 2003

(54) TAPPING HEAD FOR TAPPING BEVERAGES PRESSURIZED BY GAS

(75) Inventor: Rudolph Till, Lauf-Aubach (DE)

(73) Assignee: IPE Engineering GmbH, Lauf-Aubach (DE)

( * ) Notice: Subject to any disclaimer, the term of this patent is extended or adjusted under 35 U.S.C. 154(b) by 0 days.

(21) Appl. No.: 10/010,529

(22) Filed: Dec. 7, 2001

(65) Prior Publication Data

US 2002/0074352 A1 Jun. 20, 2002

(30) Foreign Application Priority Data

Dec. 20, 2000 (DE) ..... 200 21 655

(51) Int. Cl.[7] ..... B67D 1/08

(52) U.S. Cl. ..... 222/148; 222/394; 222/505; 141/90; 141/91; 141/352

(58) Field of Search ..... 222/148, 394, 222/400.7, 400.8, 505, 509; 141/89–91, 351, 352

(56) References Cited

U.S. PATENT DOCUMENTS 3,522,824 A * 8/1970 Allen et al. ..... 141/90
4,024,896 A * 5/1977 Ishioka et al. ..... 141/90
5,240,048 A * 8/1993 Diehl ..... 141/39
5,313,990 A * 5/1994 Clusserath ..... 141/6
5,740,945 A 4/1998 Shipway
5,960,838 A * 10/1999 Tietz et al. ..... 141/89
6,223,955 B1 * 5/2001 Till ..... 222/400.7

* cited by examiner

*Primary Examiner*—J. Casimer Jacyna
(74) *Attorney, Agent, or Firm*—Collard & Roe, P.C.

(57) ABSTRACT

A tapping head that is coupled to a disinfectant pump, the tapping head is for tapping beverages pressurized by gas. This tapping head comprises a housing, and a tapping tappet, disposed within the housing. This tapping tappet has at least one channel. There is also an actuating lever coupled to the housing. There is also a beverage closing valve disposed within the housing. Furthermore, there is also a fitting disposed at an end of the tapping tappet. When in operation, a disinfectant for disinfecting an area of the fitting is fed first via the actuating lever wherein the tapping tappet is subsequently moved against a $CO_2$ connector of the fitting area whereby the beverage closing valve is opened.

6 Claims, 7 Drawing Sheets

TAPPING HEAD FOR TAPPING BEVERAGES PRESSURIZED BY GAS

BACKGROUND OF THE INVENTION

1. Field of the Invention

The invention relates to a tap or tapping head for tapping beverages pressurized by gas. The tapping head can be mounted on a container such as a barrel.

2. The Prior Art

Tapping heads are known in the art. For example, German Patent DE 299 19 616.7 discloses a tapping head that comprises a closing pin that is disposed in a housing and surrounded by a slide that can be moved up and down into the closing position via an actuating lever. This tapping head is designed so that the head space is omitted, so that no venting of the head space is required.

However, with all tapping heads, the beverage outlet of the container closure or fitting is opened first. In addition, the conveying gas closure of the container closure or fitting is opened so that the beverage is able to penetrate the area of the tapping head for the conveying gas as the beverage container is being closed and tapped.

Now, the present invention is designed so that there is a leakage free closing and tapping of the beverage container while the container closure or fitting and the bottom side of the tapping head are disinfected at the same time.

SUMMARY OF THE INVENTION

The embodiment of the taping head according to the invention, allows a disinfectant to be conveyed from a disinfectant pump into the area of the valve for connecting the beverage. This design permits the introduction of the disinfectant, the opening of the connection for the conveying gas, and only then the opening of the container closure or fitting. The tapping head can include a housing, and a tapping tappet, which is disposed in the housing. There is also an actuating lever pivotally coupled to the housing. A beverage closing valve is disposed within this housing. This beverage closing valve has at least one channel. There is also a fitting disposed adjacent to an end of the tapping tappet. This fitting has a disinfectant for disinfecting an area of the fitting. This disinfectant is fed first via an actuating lever. Next, the tapping tappet is subsequently moved against a $CO_2$ connector of the fitting so that the beverage closing valve is opened to allow beer to flow.

This design may also include a disinfectant line coupled to the disinfectant pump, a gas conveying valve disposed within the tapping tappet and a plurality of cam disks coupled to the actuating lever. One or more of these cam discs can activate the disinfectant pump, the beverage closing valve, or the tapping tappet, when the actuating lever is activated.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
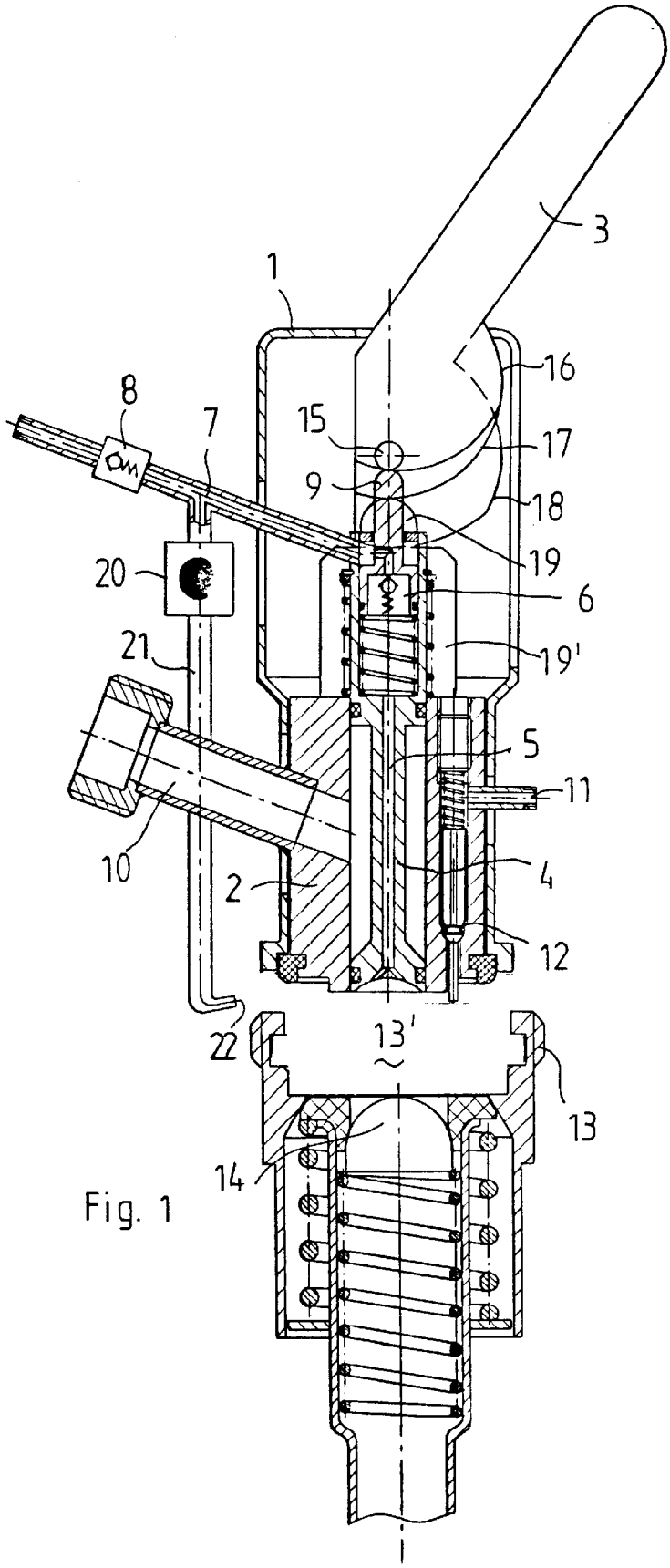
FIG. 1 shows an embodiment of the tapping head of the invention in a tapping position but not yet in its mounted position on a fitting of a barrel.
Figure 2:
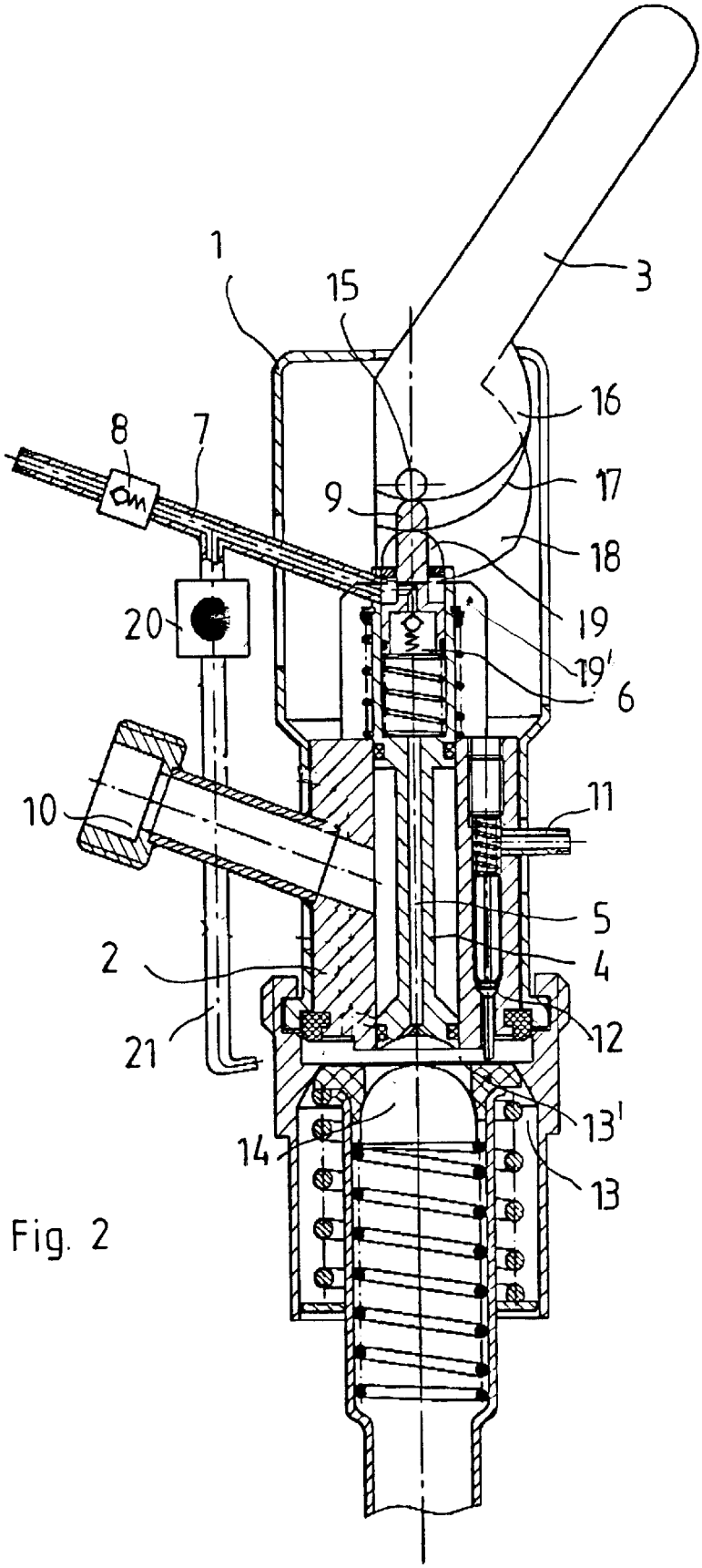
FIG. 2 shows the tapping head of FIG. 1 mounted on the fitting of the barrel.
Figure 3:
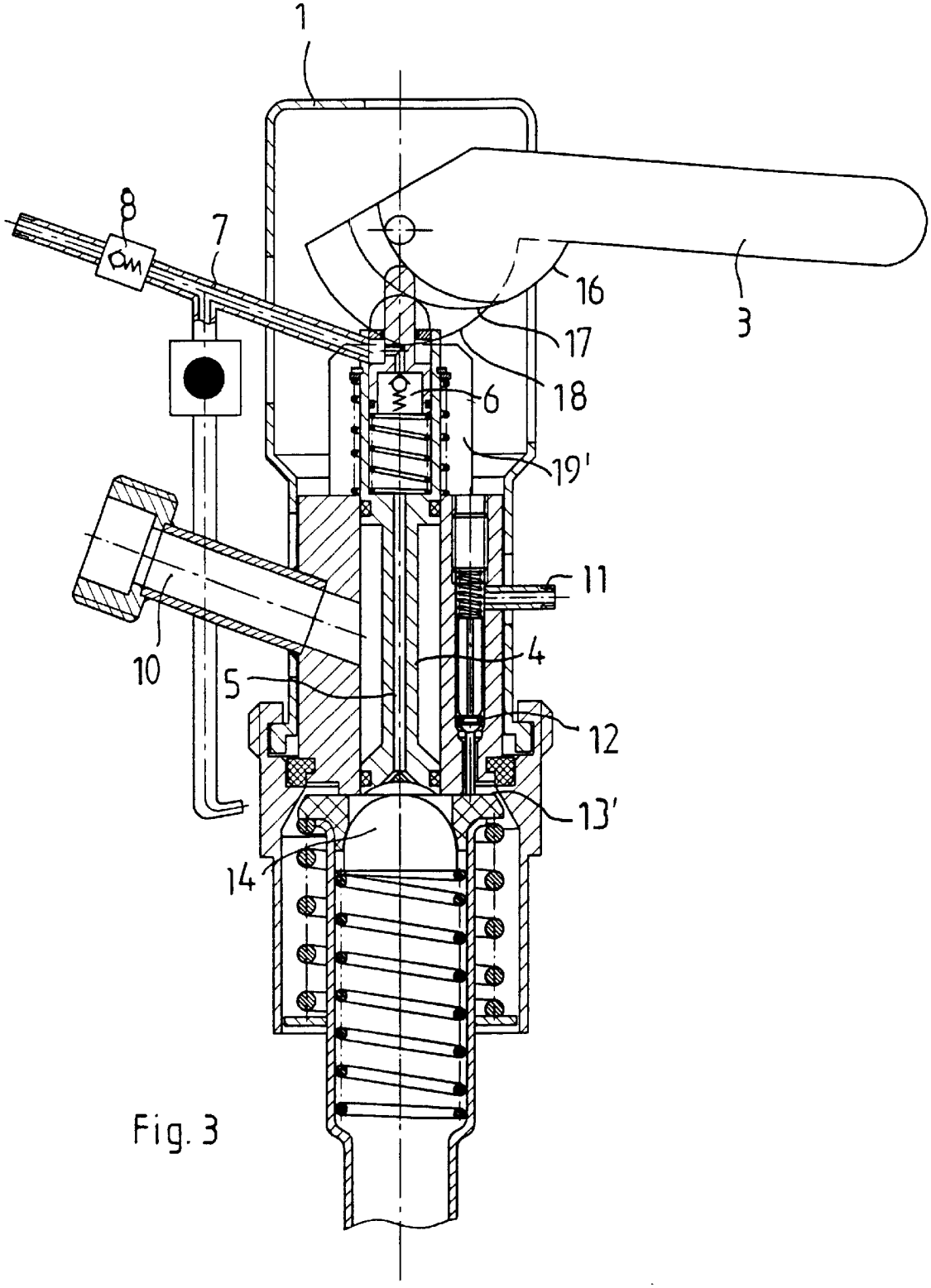
FIG. 3 shows the tapping head of FIG. 1 positioned in the center between the closed and tapped position.

Referring to the drawings, FIG. 1 shows the tapping head as defined by the invention. This tapping head comprises a tapping tappet 2 disposed in a housing 1. Tapping tappet 2 can be moved up and down via an actuating lever 3 into the tapped position as shown in FIGS. 1 and 2, an intermediate position in FIG. 3, and in the closed position shown in FIG. 4.

A beverage closing valve 4 is disposed within the tapping tappet 2, with a channel 5 for a disinfectant present in this valve. This channel 5 leads to a plunger pump 6 that is connected with a disinfectant connection 7 which comprises a check valve 8 located in the rear area. Plunger pump 6 comprises an actuation nipple 9 projecting upwards.

Furthermore, a beverage line 10 leading to the bar counter is arranged in the tapping tappet 2. Moreover, a connectional 11 for the conveying gas with a valve 12 for the conveying gas is located in tapping tappet 2. A container fitting 13 is located below beverage closing valve 4 and has a closure 14 for the beverage channel.

Actuating lever 3, which is supported in a site 15, has three cam disks 16, 17, and 18, which are arranged in an offset manner, and serve a number of functions. When lever 3 is actuated, cam disk 16 actuates disinfectant pump 6, via a nipple 9. Disinfectant pump 6 is designed as a plunger pump. This causes the disinfectant to flow into the disinfectant channel 6 and to disinfectant area 13' of fitting 13.

When in the position shown in FIG. 1, the tapping head is still located above fitting 13. There is a disinfectant line 21 that is connected with disinfectant line 7 via a disinfectant pump 20 to disinfect the pump. When pump 20 is actuated, the disinfectant can exit from lower outlet 22 of line 21 and disinfect the lower open area of the tapping head not located on the fitting.

When located in the position shown in FIG. 2, the tapping head is already located on fitting 13, but not yet in the closed position. When lever 3 is actuated and moves into the center position, shown in FIG. 3, second cam disk 17 actuates beverage closing valve 4, via top part 19, and moves the valve down.

Figure 4:
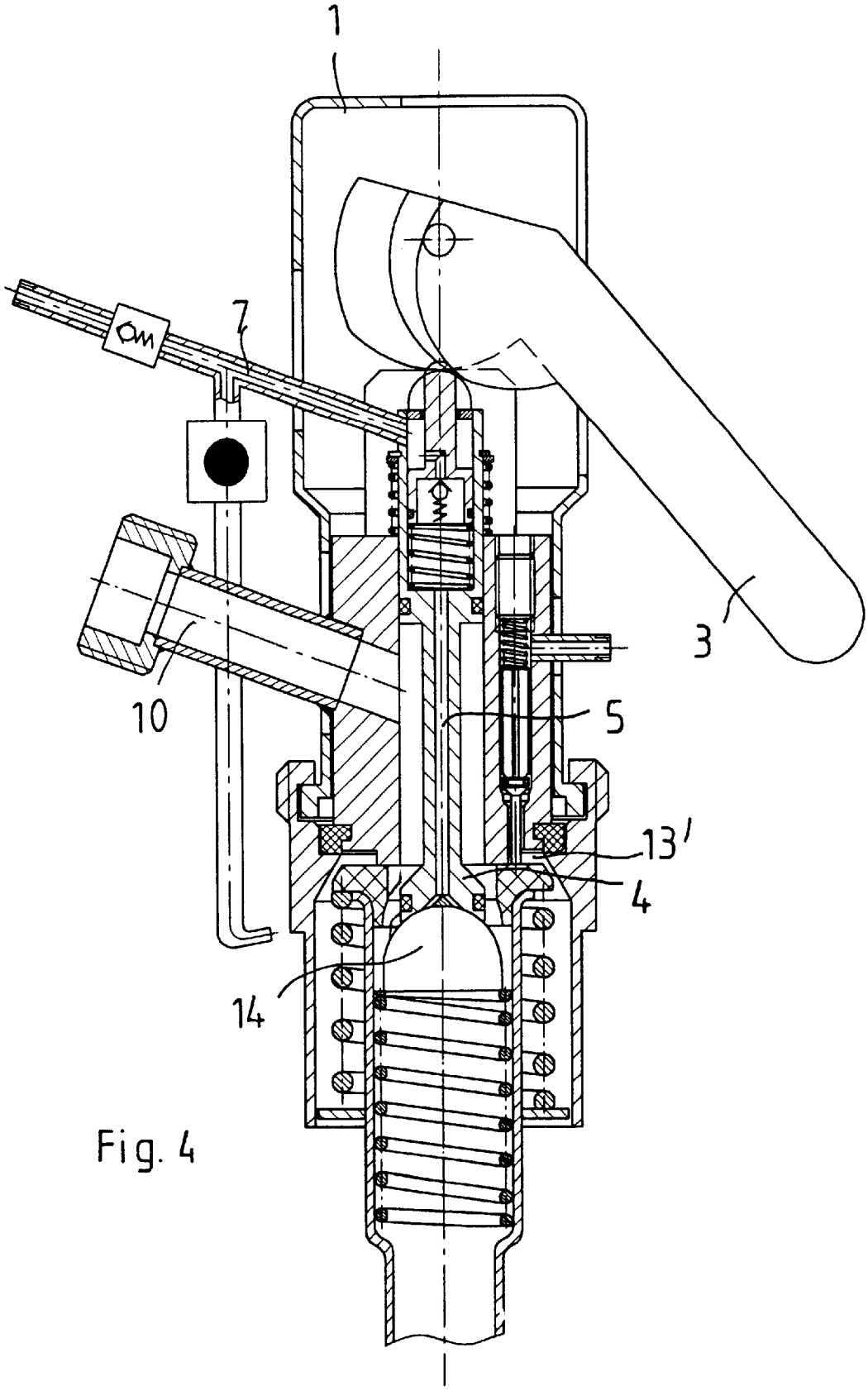
FIG. 4 shows the tapping head of FIG. 1 in the closed position.

A third cam disk 18 moves the tapping tappet 2 with the gas and beverage line at the same time, via top end 19', and presses tapping tappet 2 down into its seat against the $CO_2$ connection with valve 12. This opens the $CO_2$ connection wherein the seal located within the zone of the fitting is also opened. This is shown in FIG. 4 where the tapping head is in the tapping position. In this position, closure 14 closes the beverage closing valve on its bottom side. The conveying gas can then flow through line 11 and valve 12, which has been pushed back, and can now be received in space 13'.

Figure 5:
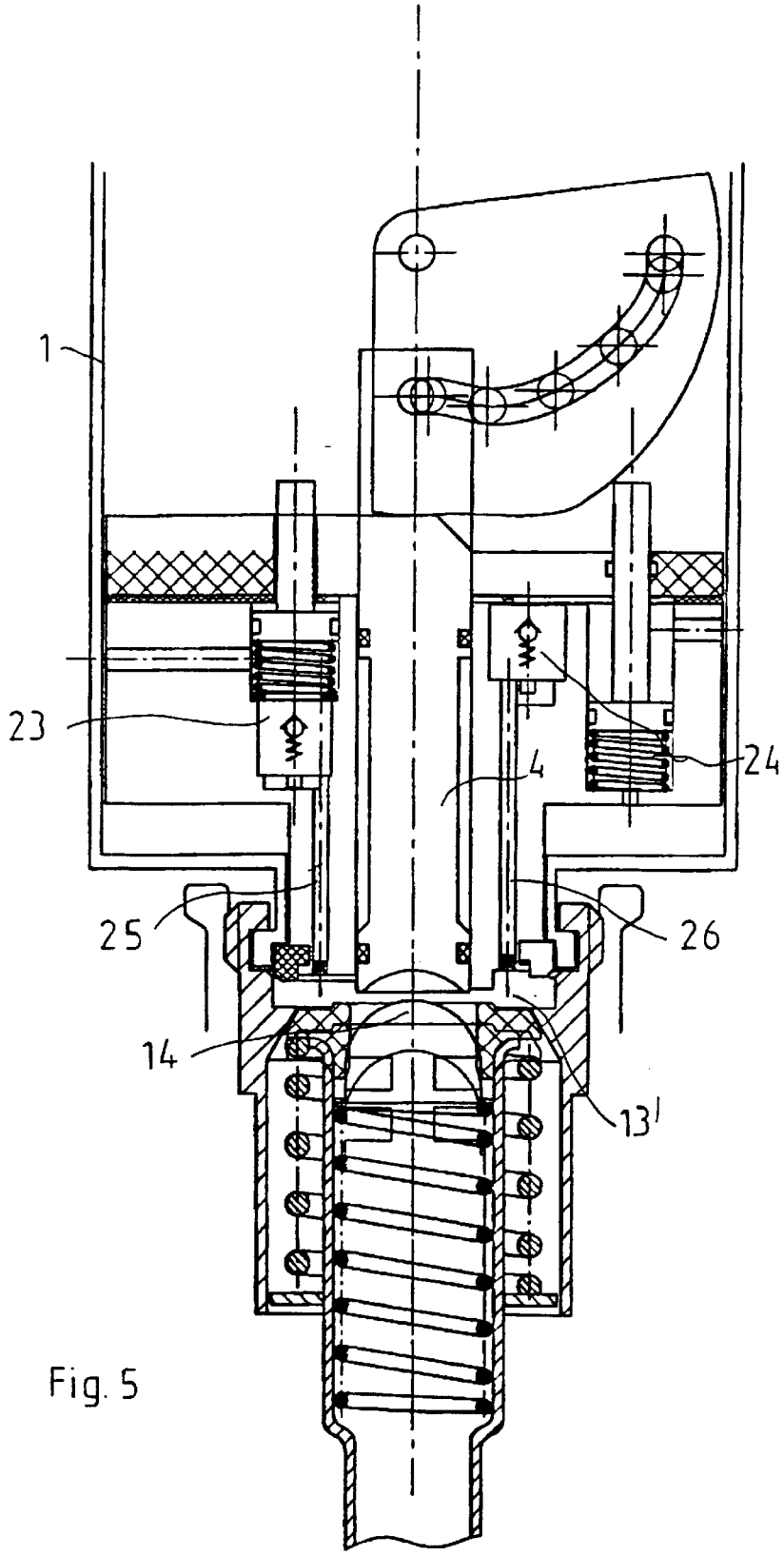
FIG. 5 shows another embodiment of the tapping head as defined by the invention in the tapped position.

FIG. 5 shows a modified embodiment of the tapping head as defined by the invention. A channel for the disinfectant is not present in this embodiment in the center of beverage closing valve 4. Two pumps 23, and 24 for conveying the disinfectant, which operate against each other, are disposed in housing 1. Left pump 23 conveys the disinfectant into a tappet line 25 located in the tappet in space 13' for disinfecting the tappet. Right pump 24 conveys the disinfectant into space 13' via another line 26.

Figure 6:
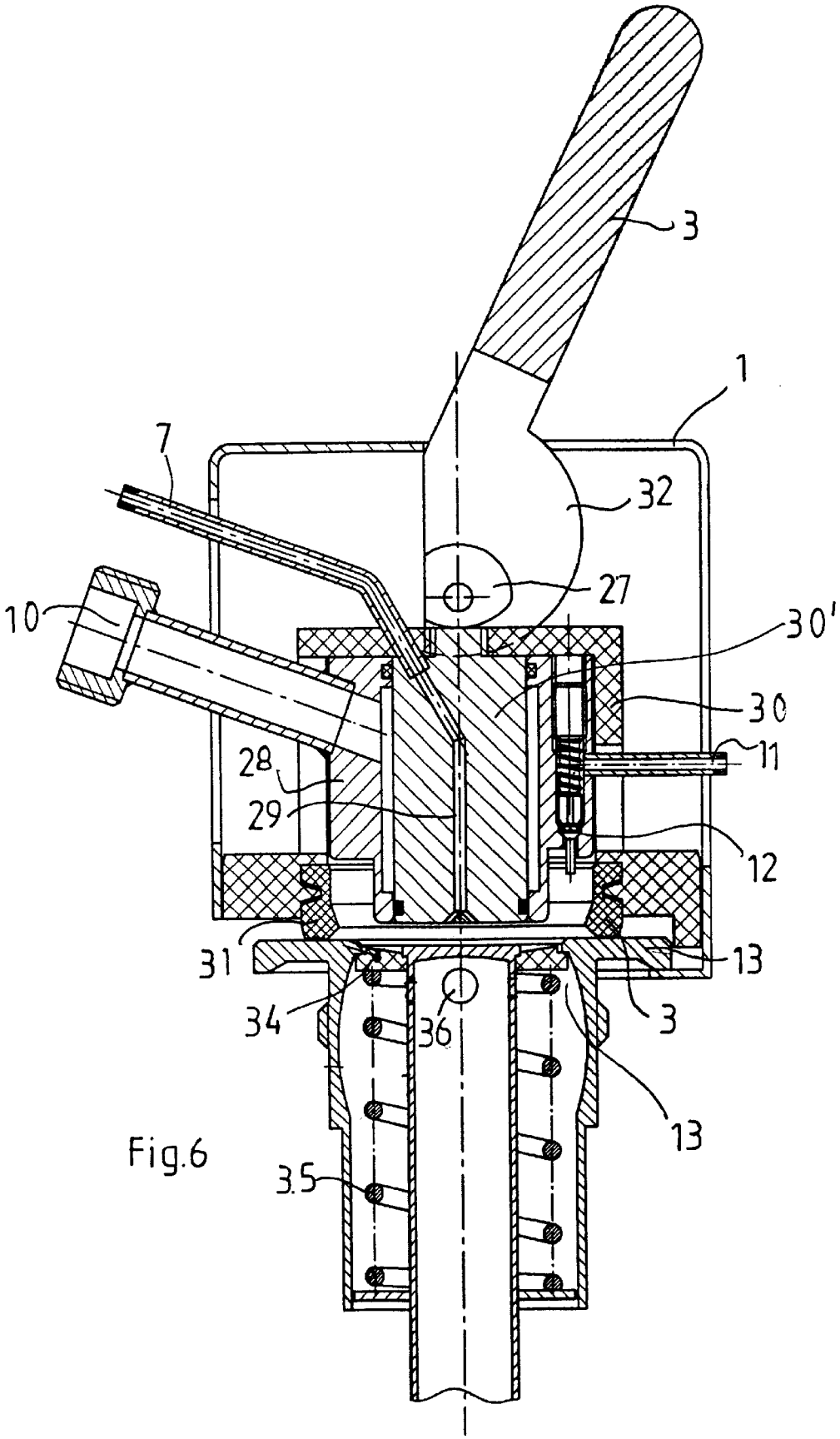
FIG. 6 shows yet another embodiment of the tapping head as defined by the invention in the tapped position.
Figure 7:
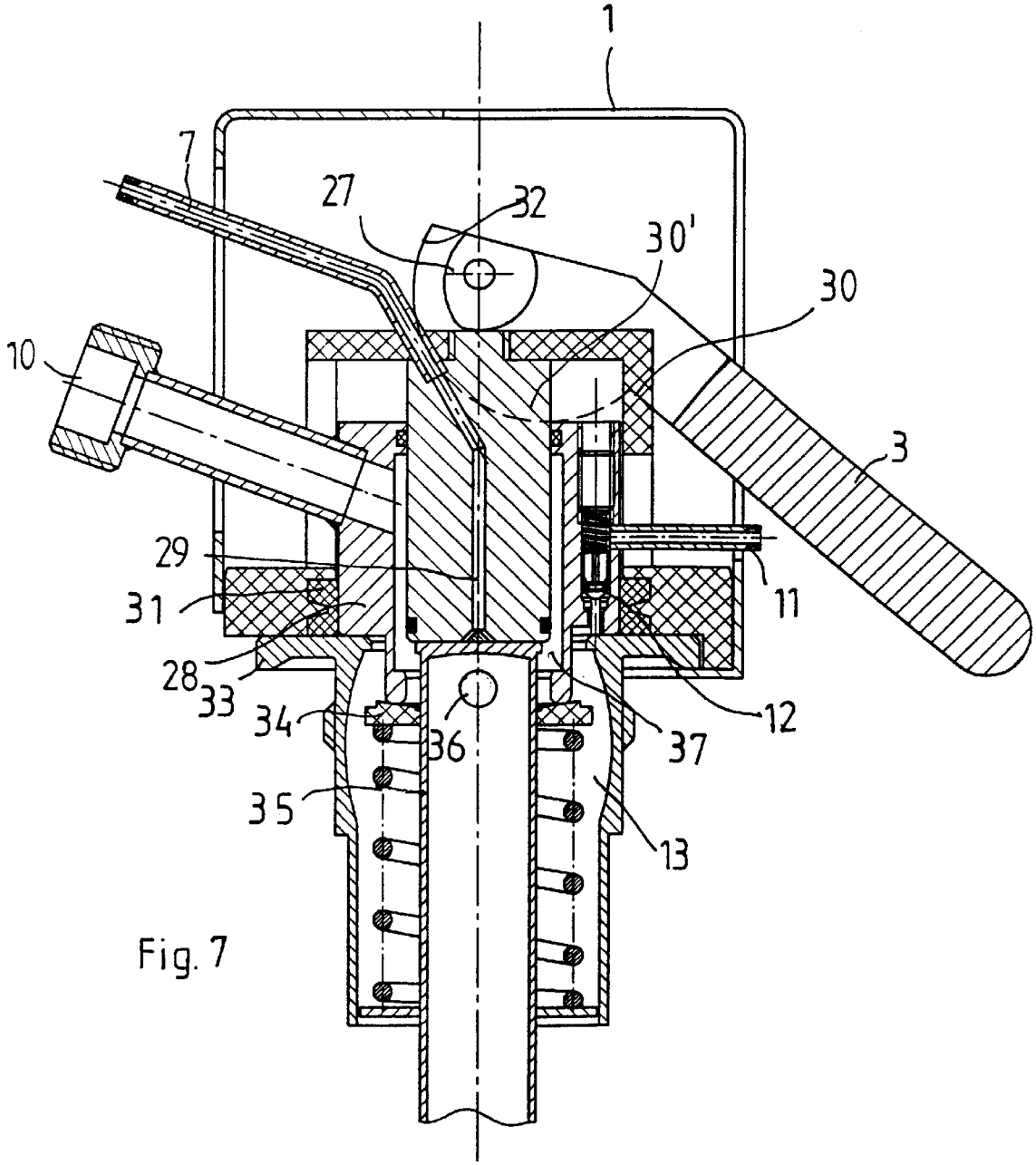
FIG. 7 shows the tapping head according to FIG. 6 in the closed position.

FIGS. 6 and 7 show another embodiment of the tapping head as defined by the invention. In this embodiment, lever 3 actuates tappet 30' via another cam disk 27. Tappet 30' has a disinfectant channel 29 in its interior that is connected with disinfectant line 7. In the external area, tappet 30 is connected with a seal 31.

When lever 3 is moved down, cam disk 27 presses sealing tappet 30 and tappet 30' down, so that seal 31 and tappet 30' are pressed onto fitting 33 shown in FIG. 6. At the same time, cam disk 32 presses beverage tappet 28 down against the pressure of spring 35. The beer can now flow through a special bore 36 into space 37 and can be conveyed via line 10 into the bar counter shown in FIG. 7. The conveying gas can then be received via line 11 and pushed-back valve 12 in space 13 and provide there for the conveyance of the beverage.

Accordingly, only two embodiments of the present invention has been shown and described, it is to be understood that many changes and modifications may be made thereunto without departing from the spirit and scope of the invention as defined in the appended claims.

What is claimed is:

1. A tapping head coupled to a disinfectant source, the tapping head for disinfecting a fitting for tapping beverages pressurized by gas comprising:

a) a housing;

b) a tapping tappet disposed within said housing;

c) an actuating lever pivotably coupled to said housing;

d) a beverage closing valve having at least one channel and disposed within said housing; and e) a fitting disposed adjacent an end of said tapping tappet; wherein a disinfectant for disinfecting an area of said fitting is fed first via said actuating lever wherein said tapping tappet is subsequently moved against a gas connector of said fitting area whereby said beverage closing valve is opened allowing beverages to flow.

2. The tapping head as in claim 1, further comprising:

a) a disinfectant line disposed within said tapping tappet and coupled to the disinfectant pump;

b) a gas conveying valve disposed within said tapping tappet;

c) a first cam disk coupled to said actuating lever, for actuating a disinfectant pump coupled to said disinfectant line which feeds disinfectant into a fitting zone of said fitting via said disinfectant channel;

d) a second cam disk coupled to said actuating lever, wherein when said actuating lever rotates, said second cam disk moves said beverage closing valve down via an upper end on said tapping tappet; and e) a third cam disk coupled to said actuating lever, wherein as said actuating lever rotates, said third cam disk moves said tapping tappet down into a seat against a gas connection with said gas flow valve so that said gas connection is opened and a seal located within the zone of the fitting is also opened.

3. The tapping tappet as in claim 2, further comprising a conveying gas connection, coupled to said tapping tappet in a $CO_2$ zone via said gas conveying valve.

4. The tapping head as in claim 3, further comprising:

a plunger pump coupled to said disinfectant line;

an additional conveying gas connection which is connected with said disinfectant line via said plunger pump, wherein said conveying gas connection has a lower opening directed at a lower area of the tapping head.

5. The tapping head as in claim 1, further comprising:

a) a tappet line coupled to said disinfectant line;

b) at least two disinfectant pumps, wherein a left pump conveys the disinfectant during a downward movement from line to tappet line into said space and a right pump conveys the disinfectant during the upward movement or tapping of the container into said space via a second tappet line.

6. A tapping head comprising:

a) a housing having a chamber with a bore;

b) at least one beverage line feeding into said housing;

c) a plurality of tappets comprising at least one beverage tappet at least one sealing tappet, and at least one additional sealing tappet;

d) at least one actuating lever rotatably mounted within said housing;

e) at least one cam disk coupled to said actuating lever;

f) at least one seal disposed within said housing, said seal for sealing said at least one beverage tappet within said housing; and g) at least one seal dish coupled to said at least one sealing tappet, wherein when said actuating lever is rotated, said at least one cam disk moves said plurality of tappets down so that said seal is pressed onto the fitting, whereby said beverage tappet simultaneously presses said seal dish down, so that the beverage can be conveyed through said bore to said beverage line.

* * * * *